US007249539B2

(12) United States Patent
Decaprio

(10) Patent No.: US 7,249,539 B2
(45) Date of Patent: Jul. 31, 2007

(54) OPEN END RATCHET WRENCH

(76) Inventor: Vincent Decaprio, 6 Payne Rd., Elmsford, NY (US) 10523

( * ) Notice: Subject to any disclaimer, the term of this patent is extended or adjusted under 35 U.S.C. 154(b) by 0 days.

(21) Appl. No.: 11/406,033

(22) Filed: Apr. 18, 2006

(65) Prior Publication Data

US 2006/0230882 A1 Oct. 19, 2006

Related U.S. Application Data

(60) Provisional application No. 60/672,247, filed on Apr. 18, 2005.

(51) Int. Cl.
*B25B 13/46* (2006.01)

(52) U.S. Cl. ..... 81/58.2; 81/60

(58) Field of Classification Search ..... 81/58, 81/58.1, 60–63.2
See application file for complete search history.

(56) References Cited

U.S. PATENT DOCUMENTS 2,294,510 A 9/1942 Nakano
2,982,162 A * 5/1961 Golden ..... 81/176.3
4,095,494 A 6/1978 Castoe
4,258,595 A * 3/1981 Ramsey ..... 81/61
4,441,387 A * 4/1984 Hendricks ..... 81/61
4,562,757 A * 1/1986 Furey ..... 81/63
5,277,087 A * 1/1994 Wilson et al. ..... 81/57.29
5,454,283 A * 10/1995 Stefano ..... 81/58.2
5,501,124 A * 3/1996 Ashby ..... 81/58.2
5,768,960 A 6/1998 Archuleta
6,050,165 A * 4/2000 Hall ..... 81/63.1
6,138,533 A 10/2000 Turtle
6,286,396 B1 9/2001 Johnson

* cited by examiner

*Primary Examiner*—D. S. Meislin
(74) *Attorney, Agent, or Firm*—James Ray & Assoc.

(57) ABSTRACT

A ratchet wrench includes a generally open head member and a handle connected thereto. A pair of generally C-shaped collars are hingedly connected to the head member for selectively closing and opening it and a locking tab provided for selectively locking the collars in a position for closing the head member. A pair of semi-circular inserts are disposed within the collars and form a socket axially disposed within the head member and further form a peripheral ratchet wheel. A ratchet pawl engages the ratchet wheel for facilitating ratcheting rotation. The wrench may be adapted with an electrical drive for operating the ratchet wheel.

5 Claims, 3 Drawing Sheets

OPEN END RATCHET WRENCH

CROSS-REFERENCE TO RELATED APPLICATIONS

This application is related to and claims priority from Provisional Patent Application Ser. No. 60/672,247 filed Apr. 18, 2005.

FIELD OF THE INVENTION

The present invention relates, in general, to wrenches and, more particularly, this invention relates to a ratchet wrench that is capable of engaging a fastener in a direction that is perpendicular to the axis of such fastener.

BACKGROUND OF THE INVENTION

As is generally well known, attachment or removal of a fuel line or a hydraulic line requires employment of an open end box wrench or a crescent wrench in order to accommodate a tubing which extends from one end of the line connector. Such line connector is normally a nut. These hand tools must be removed and reapplied several times as the hand tool can only engage the fastening nut in a direction which is generally perpendicular to the axis of the tubing and where such direction further coincides with the plane of the nut. The process is tedious and exasperating for the person tasked with removal or attachment of the fuel lines.

As it further known, conventional ratchet wrenches having a closed head cannot be used in such applications, as they require axially unobstructed access to the fastening nut.

U.S. Pat. No. 4,095,494 to Castor discloses a ratchet wrench for working in areas of greatly limited access which includes a head having a bore extending through it, a handle secured to the head, a socket for engagement with an object to be rotated, and gear teeth spaced apart circumferentially around the outside surface of the socket. The head is split and hinged to pivot between an open position for expanding the effective size of the bore and a closed position for extending around the gear teeth of the socket when the latter is inserted in the bore.

A spring-biased locking mechanism locks the hinged portion of the head in its closed position during use. The locking mechanism is releasable to allow the head to pivot to its open position. A reversible ratchet pawl engages the gear teeth to provide reversible, unidirectional rotation of the socket relative to the head. However, such ratchet wrench requires a greater clearance around the fastener, in order to open or close the hinged portion, than some applications allow.

SUMMARY OF THE INVENTION

According to one embodiment of the invention, there is provided a ratchet wrench which includes a head member having a generally C-shaped open first end and an axially opposed second end. A handle is connected to the second end of the head member. A pair of generally C-shaped collars are engageable with a portion of the generally C-shaped open first end. There is a hinge means provided for pivotally connecting each generally C-shaped collar to a respective end portion of the C-shaped first end of the head member. Each generally C-shaped collar is pivotally movable between a first position being coplanar with and partially closing the C-shaped first end and a second position being perpendicular to a plane of and partially opening the C-shaped first end. A locking tab is provided for selectively locking the pair of generally C-shaped collars in the first position. A pair of semi-circular inserts are provided, with each insert engaging a respective one of the pair of generally C-shaped collars for pivotal movement therewith and for rotational movement thereabout. Each insert has a straight edge and an arcuate edge connecting opposed ends of the straight edge. The arcuate edge has a plurality of ratchet teeth disposed thereon, and the straight edge has a cavity of a predetermined shape. A socket is axially formed in the head member by a combination of the cavity in a first semi-circular insert and the cavity in a second semi-circular insert when the pair of generally C-shaped collars are disposed in the first position for closing the generally C-shaped open first end. The plurality of teeth in each insert form a ratchet wheel. A ratchet pawl is disposed within the second end of the head member and partially protruding into the generally C-shaped open first end for engaging the ratchet wheel.

According to another embodiment, the invention provides a ratchet wrench which includes a head member having a generally C-shaped open first end and an axially opposed second end. A handle is connected to the second end of the head member. A pair of generally C-shaped collars are engageable with a portion of the generally C-shaped open first end. There is a hinge means provided for pivotally connecting each generally C-shaped collar to a respective end portion of the C-shaped first end of the head member. Each generally C-shaped collar is pivotally movable between a first position being coplanar with and partially closing the C-shaped first end and a second position being perpendicular to a plane of and partially opening the C-shaped first end. A locking tab is provided for selectively locking the pair of generally C-shaped collars in the first position. A pair of semi-circular inserts are provided, with each insert engaging a respective one of the pair of generally C-shaped collars for pivotal movement therewith and for rotational movement thereabout. Each insert has a straight edge and an arcuate edge connecting opposed ends of the straight edge. The arcuate edge has a plurality of ratchet teeth disposed thereon, and the straight edge has a cavity of a predetermined shape. A socket is axially formed in the head member by a combination of the cavity in a first semi-circular insert and the cavity in a second semi-circular insert when the pair of generally C-shaped collars are disposed in the first position for closing the generally C-shaped open first end. The plurality of teeth in each insert form a toothed wheel. The wrench further includes an electric drive for rotating the toothed wheel and a switch for operating the electric drive.

According to yet another embodiment of the invention, there is provided a split socket for a hand tool. The socket includes a first member having a first end, an axially opposed second end and a first surface extending therebetween, the first surface having a first axial cavity disposed therein. The socket further includes a second member having a first end, an axially opposed second end and a first surface extending therebetween, the first surface having a second axial cavity disposed therein. A socket portion is formed by the first axial cavity and the second axial cavity when the first surface of the first member abuts the first surface of the second member, wherein at least a portion of the socket means abuts a peripheral surface of a threaded fastener. Interlocking members are provided for enabling axial movement and for preventing radial movement of the first and second member to each other.

OBJECTS OF THE INVENTION

It is, therefore, one of the primary objects of the present invention to provide a ratchet wrench having a selectively openable and closeable head for engaging a fastener in a direction that is perpendicular to the axis of such fastener.

Another object of the present invention is to provide a ratchet wrench having a selectively openable and closeable head which is capable of simply retaining a socket therein.

Yet another object of the present invention is to provide a ratchet wrench having a selectively openable and closeable head which employs a reversible ratcheting mechanism.

A further object of the present invention is to provide a ratchet wrench having a selectively openable and closeable head which employs a locking mechanism for locking such head in a closed position.

Yet a further object of the present invention is to provide a ratchet wrench having a selectively openable and closeable head which employs powered ratcheting drive.

An additional object of the present invention is to provide a split socket extension for a ratchet wrench.

In addition to the several objects and advantages of the present invention which have been described with some degree of specificity above, various other objects and advantages of the invention will become more readily apparent to those persons who are skilled in the relevant art, particularly, when such description is taken in conjunction with the attached drawing Figures and with the appended claims.

BRIEF DESCRIPTION OF THE VARIOUS EMBODIMENTS OF THE INVENTION

Figure 1:
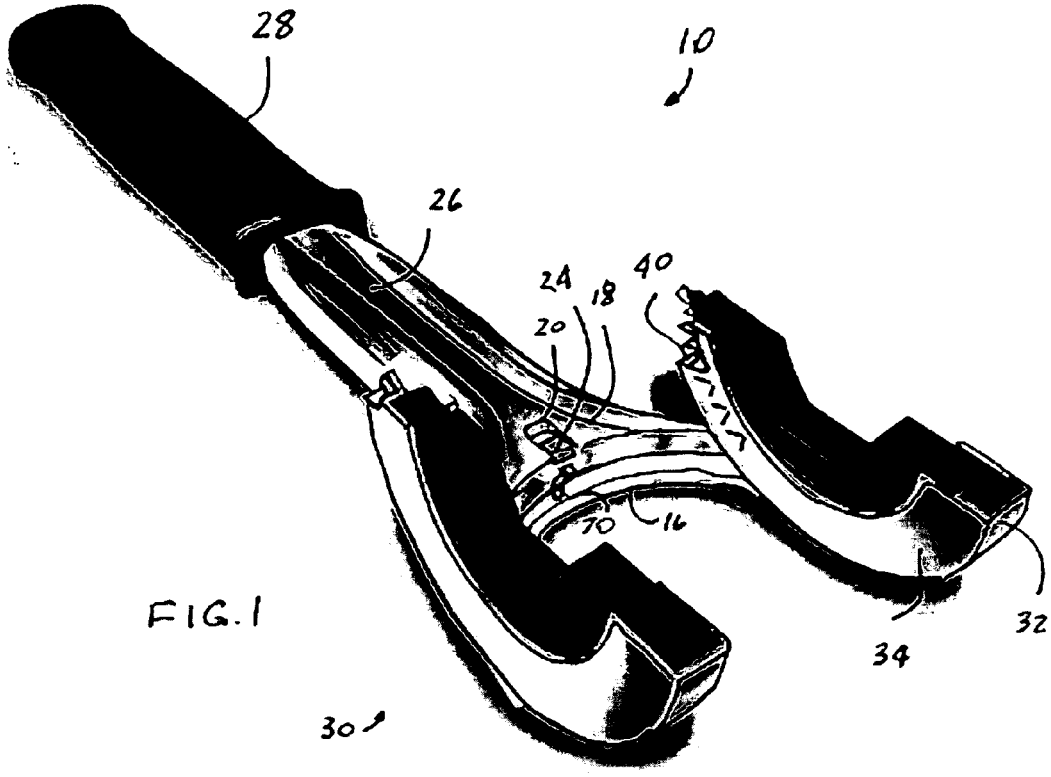
FIG. 1 is a perspective view of a ratchet wrench according to one embodiment of the present invention showing inserts and collars positioned for opening a head end of the wrench.

Prior to proceeding to the more detailed description of the present invention, it should be noted that, for the sake of clarity and understanding, identical components which have identical functions have been identified with identical reference numerals throughout the several views illustrated in the drawing figures.

Figure 2:
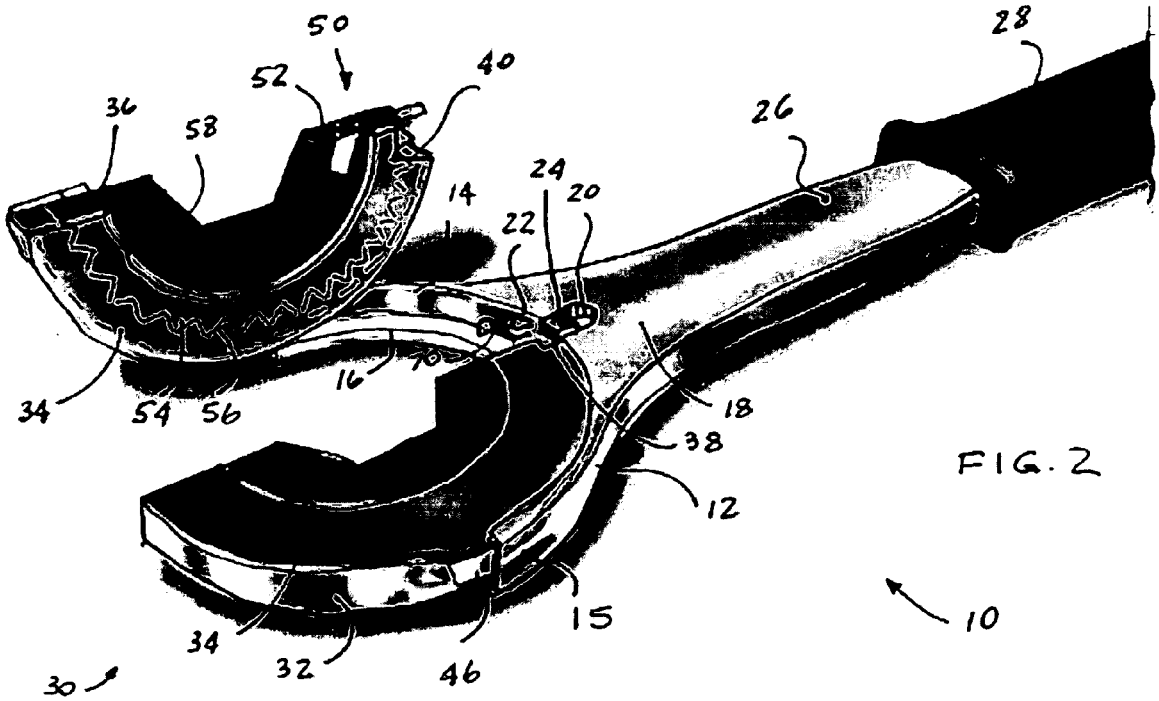
FIG. 2 is a partial perspective view of the ratchet wrench of FIG. 1 showing alternatively positioned inserts and collars.
Figure 3:
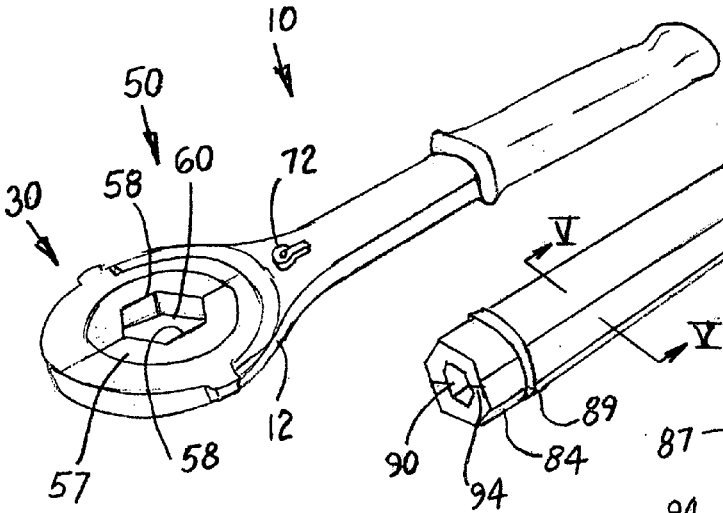
FIG. 3 is a perspective view of the ratchet wrench of FIG. 1 showing inserts and collars positioned for closing the head end of the wrench.

According to a first embodiment of the invention, illustrated in FIGS. 1-3, there is provided a ratchet wrench, generally designated 10. Such ratchet wrench 10 includes a head member 12 having a generally C-shaped open first end 14 and an axially opposed second end 18. A handle 26 is connected to the second end 18 of the head member 12. Even though, the handle 26 is illustrated in FIG. 1 as being rigidly attached to and extending outwardly from the second end 18, such handle 26 may be attached in a swivel fashion which is well known in the art. The handle 26 may be provided with a grip means, such as a sleeve 28, which is preferably manufactured from a non-slip elastomeric or plastic material.

There is a pair of identical generally C-shaped collars, each generally designated 30, and a hinge means 46 which is provided for pivotally connecting each generally C-shaped collar 30 to a respective end portion 15 of the C-shaped first end 14 of the head member 12. In such embodiment, each generally C-shaped collar 30 is pivotally movable between a first position coplanar with and closing the C-shaped first end 14, as best shown in FIG. 3, and a second position perpendicular to a plane of and opening the C-shaped first end 14, as shown in FIG. 1.

A semi-circular flange 16 is provided within the generally C-shaped open first end 14 for limiting pivotal rotation of the C-shaped collars 30 and for supporting them in such first position.

A locking means 24 is provided for selectively locking the pair of generally C-shaped collars 30 in the first position. In the presently preferred embodiment of the invention, such locking means 24 is a simple tab 24 mounted for linear movement within a slot 20 formed in the head member 12. The tab 24 is manually movable in a first direction for engaging a pair of complimentary notches 38, each disposed in a respective one of the pair of generally C-shaped collars 30 in order to lock the pair of generally C-shaped collars 30 in the first position. The tab 24 is movable in an opposed second direction for disengaging the pair of notches 38 and for enabling pivotal movement of the pair of generally C-shaped collars 30 into the second position for opening the generally C-shaped open end 14.

There is a pair of identical semi-circular inserts, each generally designated 50. Each semi-circular insert 50 is engageable with a respective generally C-shaped collar 30 for pivotal movement therewith and rotational movement thereabout. Each semi-circular insert 50 has a straight edge 52 and an arcuate edge 54 connecting opposed ends of the straight edge 52. The arcuate edge 54 has a plurality of ratchet teeth 56 disposed thereon. The straight edge 52 has a cavity 58 of a predetermined shape. Furthermore, each of the generally C-shaped collars 30 includes a groove 36, formed by a base member 32 and a pair of parallel flange portions 34 extending outwardly from the base portion 32 for receiving the arcuate edge 54 of each semi-circular insert 50.

Each semi-circular insert 50 is preferably retained within the groove 36 by way of magnetic properties associated with one of the pair of semi-circular inserts 50 and the pair of generally C-shaped collars 30. Such semi-circular inserts 50 may be made from a magnetic material or may be formed from a steel material and magnetized by a secondary process. Accordingly, the generally C-shaped open first end 14 of the head member 12 may be magnetized to retain semi-circular inserts 50 manufactured from a material such as steel.

Advantageously, a socket means 60 is axially formed in the head member 12 by a combination of the cavity 58 in the first semi-circular insert 50 and an opposed cavity 58 in a second semi-circular insert 58 when the pair of generally C-shaped collars 30 are disposed in the first position for closing the generally C-shaped open first end 14. Such socket means 60 may be formed as a hex socket, wherein each cavity 58 has a semi-hex form or it may be formed in any other shape utilized in the hand tool art for tightening and loosening a fastener (not shown). Furthermore, the first semi-circular insert 50 and the second semi-circular insert 50 form a ratchet wheel 57 when such pair of generally C-shaped collars 30 are disposed in the first position. It will be appreciated that the socket means 60 will be sized to fit a particular size of the fastener (not shown).

To enable ratcheting of such ratchet wheel 57, the wrench 10 includes a ratchet pawl means 70 disposed within the second end 18 of the head member 12 and partially protruding into the generally C-shaped open first end 14 for engaging the ratchet wheel 57. Such ratchet pawl means 70 enables coupled rotation of the ratchet wheel 57 with the pair of generally C-shaped collars 30, the head member 12 and the handle 26 in one direction for transferring a torque to a fastener (not shown), wherein the torque is generated by a manual force applied to the handle 26. The ratchet pawl means 70 further enables ratcheting rotation of the pair of generally C-shaped collars 30, the head member 12 and the handle 26 in an opposed direction while the ratchet wheel 57 remains in a temporary stationary position.

In use, the collars 30 with the inserts 50 retained therein are manually pivoted into the second position enabling the open end 14 to be positioned around a fastener (not shown). It will be appreciated that the ratchet wrench 10 is positioned in a direction that is perpendicular to the axis of such fastener (not shown). The collars 30 with the inserts 50 are then pivoted into the first position for closing the open end 14 and for abutment of the socket means 60 with the fastener (not shown).

The tab 24 is manually moved in the first direction to lock the collars 30 in such first position and the force is applied to the handle 26 to tighten or loosen the fastener (not shown). To reverse condition of the fastener (not shown) the tab 24 is manually moved in the second direction unlocking the collars 30 which are then pivotally rotated into the second position for opening the generally C-shaped open end 14. The wrench 10 is then flipped 180 degrees and the process is repeated to reverse the condition of the fastener (not shown). When it is desirable to tighten and loosen the fastener (not shown) without removal of the wrench 10, the ratchet pawl means 70 is adapted to include a direction changing means 72.

Figure 4:
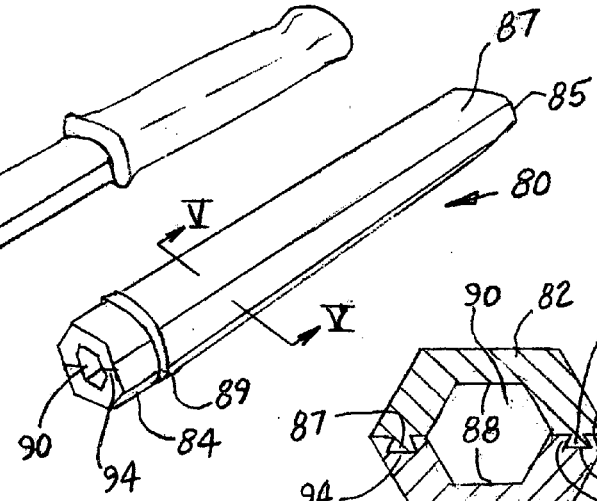
FIG. 4 is a perspective view of a split socket extension for the ratchet wrench according to another embodiment of the present invention.
Figure 5:
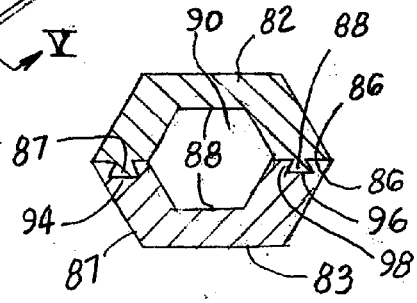
FIG. 5 is a cross-sectional view of the split socket extension taken along the lines 5-5 of FIG. 4.

Additionally, a split socket extension, generally designated 80, shown in FIGS. 4-5, may be provided for use with a fastener (not shown) disposed in a partially concealed position. Such split socket extension 80 includes a pair of opposed members 82 and 83, each having a first end 84, an axially opposed second end 85 and a first surface 86 extending therebetween. The first surface 86 has a first axial cavity 88 disposed therein.

A socket portion 90 is formed by such pair of axial cavities 88 when the first surface 86 of the first member 82 abuts the first surface 86 of the second member 83. A means 94, engageable with the pair of members 82 and 83, is provided for interlocking such pair of member 82 therebetween, wherein the first surface 86 of the first member 82 abuts first surface 86 of the second member 83.

In the presently preferred embodiment of the invention, the interlocking means 94 includes a pair of longitudinal grooves 96 disposed in one of the first member 82 and the second member 83, each longitudinal groove 96 disposed along a respective edge of the axial cavity 88, and a pair of longitudinal members 98 extend outwardly from the first surface 86 of an opposed one of the first member 82 and the second member 83, each of the longitudinal members 98 slideably engage a respective one of the pair of longitudinal grooves 96 for interlocking such pair of members 82, 83. It will be understood that the longitudinal grooves 96 and the longitudinal members 98 are shaped to prevent radial disengagement of the first member 82 from the second member 83.

Advantageously, the first end 84 is configured for engagement with the socket means 60 of the wrench 10 or with any conventional ratchet wrench. A collar 89 may be provided for limiting engagement of the first end 84. The second peripheral surface 87 of each member 82, 83 may be further configured for engagement with a fastener, such as a socket head screw (not shown) and may be tapered at a predetermined angle towards the second end 85.

Figure 6:
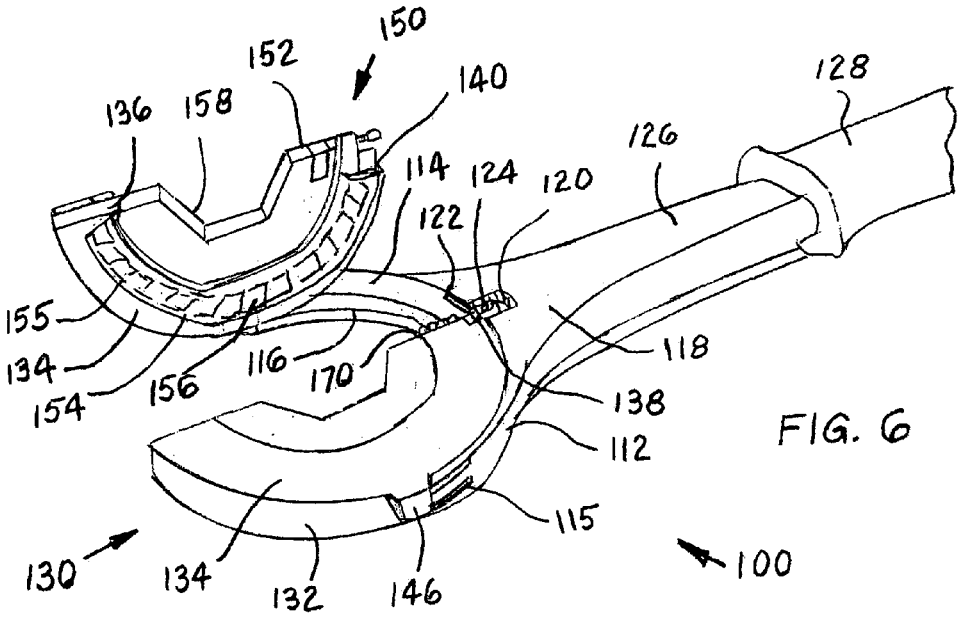
FIG. 6 a partial perspective view of a ratchet wrench according to yet another embodiment of the present invention showing alternatively positioned inserts and collars.
Figure 7:
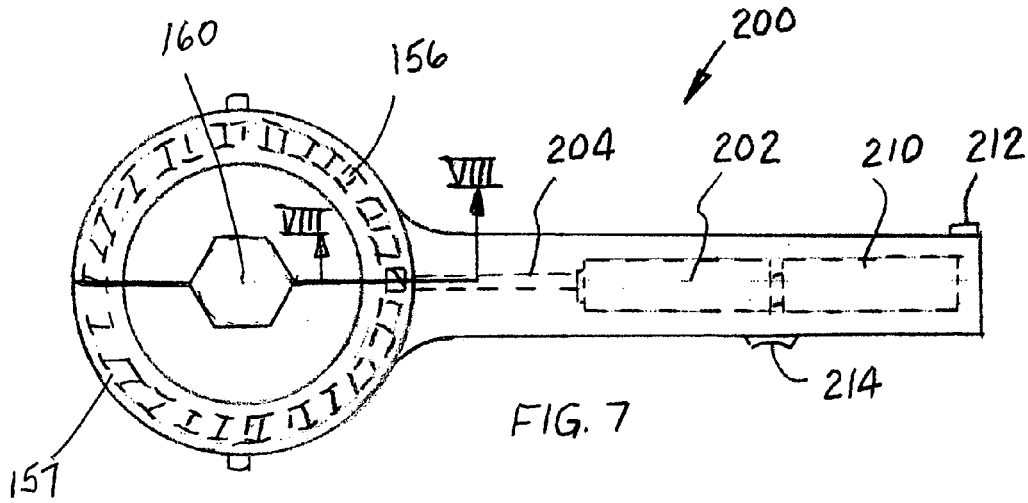
FIG. 7 is a schematic view of the ratchet wrench of FIG. 6.
Figure 8:
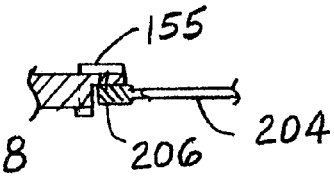
FIG. 8 is a cross-sectional view of the ratchet wrench taken along the lines 8-8 of FIG. 7.

According to a second embodiment, the present invention provides a ratchet wrench, generally designated 100 illustrated in FIGS. 6-8. Such ratchet wrench 100 includes a head member 112 having a generally C-shaped open first end 114 and an axially opposed second end 118. A handle 126 is rigidly connected to the second end 118 of the head member 112. The handle 126 may be provided with a grip means, such as a sleeve 128, which is preferably manufactured from a non-slip elastomeric or plastic material.

There is a pair of identical generally C-shaped collars, each generally designated 130. A hinge means 146 is provided for pivotally connecting each generally C-shaped collar 130 to a respective end portion 115 of the C-shaped first end 114 of the head member 112. In such embodiment, each generally C-shaped collar 130 is pivotally movable between a first position coplanar with and closing the C-shaped first end 114 and a second position perpendicular to a plane of and opening the C-shaped first end 114. A semi-circular flange 116 is provided within the generally C-shaped open first end 114 for limiting pivotal rotation of the C-shaped collars 130 and for supporting them in such first position.

A locking means 124 is provided for selectively locking the pair of generally C-shaped collars 130 in the first position. In the presently preferred embodiment of the invention, such locking means 124 is a simple tab 124 mounted for linear movement within a slot 120 formed in the head member 112. The tab 124 is manually movable in a first direction for engaging a pair of complimentary notches 138, each disposed in a respective one of the pair of generally C-shaped collars 130 in order to lock the pair of generally C-shaped collars 130 in the first position. The tab 124 is movable in an opposed second direction for disengaging the pair of notches 138 and for enabling pivotal movement of the pair of generally C-shaped collars 130.

There is a pair of identical semi-circular inserts, each generally designated 150. Each semi-circular insert 150 is engageable with a respective generally C-shaped collar 130 for pivotal movement therewith and for rotational movement thereabout. Each semi-circular insert 150 has a straight edge 152 and an arcuate edge 154 connecting opposed ends of the straight edge 152. The arcuate edge 154 has a flange 155 with a plurality of teeth 156 disposed thereon. The straight edge 152 has a cavity 158 of a predetermined shape. Furthermore, each of the generally C-shaped collars 130 includes a groove 136, formed by a base member 132 and a pair of parallel flange portions 134 extending outwardly from the base portion 132 for receiving the arcuate edge 154 of each semi-circular insert 150.

Each insert 150 is preferably retained within the groove 136 by way of magnetic properties associated with one of the pair of semi-circular inserts 150 and the pair of generally C-shaped collars 130. Such semi-circular inserts 150 may be made from a magnetic material or may be formed from a steel material and magnetized by a secondary process. Accordingly, the generally C-shaped open first end 114 of the head member 112 may be magnetized to retain semi-circular inserts 150 manufactured from a material such as steel.

Advantageously, a socket means 160 is axially formed in the head member 112 by a combination of the cavity 158 in first semi-circular insert 150 and an opposed cavity 158 in second semi-circular insert 158 when the pair of generally C-shaped collars 130 are disposed in the first position for closing the generally C-shaped open first end 114. Such socket means 160 may be formed as a hex socket, wherein each cavity 158 has a semi-hex form or it may be formed in any other shape utilized in the hand tool art for tightening and loosening a fastener (not shown). Furthermore, the first semi-circular insert 150 and the second semi-circular insert 150 form a toothed wheel 157 when such pair of generally C-shaped collars 130 are disposed in the first position. It will be appreciated that the socket means 160 will be sized to fit a particular size fastener (not shown).

A drive means, generally designated as 200, is disposed within the handle 126 and is partially protruding into the generally C-shaped open first end 114 of the head member 112 for engaging the toothed wheel 157 and, more particularly, for rotating the toothed wheel 157 in at least one direction.

The drive means 200 includes a motor 202, an output shaft 204 extending from one end of the motor 202 towards the head member 112, and a screw thread portion 206 rigidly attached to a free end of the output shaft 204 for rotation therewith, the screw thread portion 206 extends into the generally C-shaped open first end 114 of the head member 112 and is engageable with the teeth 156 of the toothed wheel 157. The motor 202 is operable by one of electrical and fluid power. In the presently preferred embodiment of the invention, the motor 202 is operable by an electrical power and the wrench 100 further includes a power source 210 coupled to a control means 214 for selectively supplying the electrical power to the drive means 200. Preferably, such power source 210 is at least one battery 210 disposed in a distal end of the handle 126. Such at least one battery 210 may be one of a rechargeable and a disposable type.

Figure 9:
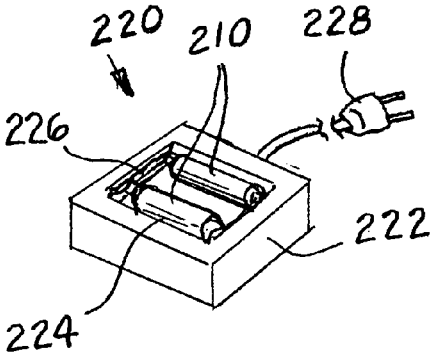
FIG. 9 is perspective view of a changing system according to one embodiment of the invention for use with a ratchet wrench of FIG. 6.

When the power source 210 is at least one rechargeable battery 210, the wrench 200 includes a recharging means, generally designated 220, for recharging such rechargeable battery 210. According to one embodiment of the invention, shown in FIG. 9, recharging means 220 includes a housing 222 having a cradle 224, at least one pair of electrical contacts 226 disposed within the cradle 224 for engagement with electrical contacts of the rechargeable battery 210 when the rechargeable battery 210 is placed into the cradle 224. An adapter 228 is provided for connecting the pair of electrical contacts 226 to an electrical outlet (not shown).

Figure 10:
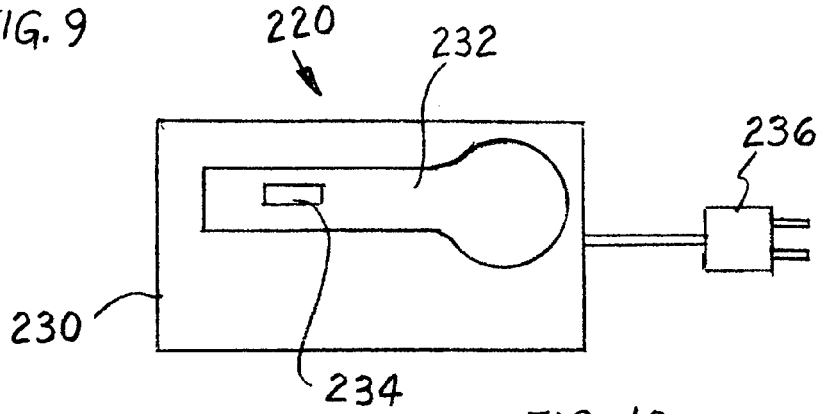
FIG. 10 is a plan view of a changing system according to another embodiment of the invention for use with a ratchet wrench of FIG. 6.

According to another embodiment of the invention, shown in FIG. 10, such recharging means 220 includes a housing 230 having a cradle 232, at least one first electrical contact 234 disposed within the cradle 232 for engagement with at least one second electrical contact 212 disposed on a predetermined portion of the handle 126 when the predetermined portion is placed into the cradle 232. An adapter 236 is provided for connecting the at least one first electrical contact 234 to an electrical outlet (not shown).

Figure 11:
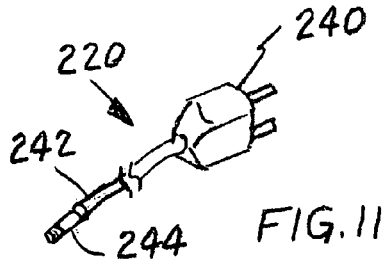
FIG. 11 is perspective view of a changing system according to yet another embodiment of the invention for use with a ratchet wrench of FIG. 6.

According to yet another embodiment of the invention, shown in FIG. 11, recharging means 220 includes an adapter 240 engageable with an electrical outlet (not shown), at least one wire 242 extends from the adapter 240 and at least one first electrical contact 244 connected to a distal end of the at least one wire 242 for coupling to a second electrical contact 212 disposed within the handle 126 and coupled to the rechargeable battery 210.

The control means 214 is preferably a simple switch 214 which is manually operable between a first position for enabling supply of the electrical power to the motor 202 and a second position for discontinuing such supply of electrical power. The switch 214 may be further operable between a third position for reversing rotation of motor 202 as known in the art. It will be understood that employment of the drive means 200 applies torque required to fasten or remove the fastener (not shown) and eliminates manual application of the force to the handle 226.

Thus, the present invention has been described in such full, clear, concise and exact terms as to enable any person skilled in the art to which it pertains to make and use the same. It will be understood that variations, modifications, equivalents and substitutions for components of the specifically described embodiments of the invention may be made by those skilled in the art without departing from the spirit and scope of the invention as set forth in the appended claims.

I claim:

1. A ratchet wrench comprising:

(a) a head member having a generally C-shaped open first end and an axially opposed second end;

(b) a handle connected to said second end of said head member;

(c) a pair of generally C-shaped collars each engageable with a portion of said generally C-shaped open first end;

(d) a hinge means for pivotally connecting each generally C-shaped collar to a respective end portion of said C-shaped first end of said head member, whereby said each generally C-shaped collar is pivotally movable between a first position coplanar with and partially closing said C-shaped first end and a second position perpendicular to a plane of and partially opening said C-shaped first end;

(e) a locking means for selectively locking said pair of generally C-shaped collars in said first position;

(f) a pair of semi-circular inserts each engageable with a respective one of said pair of generally C-shaped collars for pivotal movement therewith and for rotational movement thereabout, said each semi-circular insert having a straight edge and an arcuate edge connecting opposed ends of said straight edge, said arcuate edge having a plurality of ratchet teeth disposed thereon, and said straight edge having a cavity of a predetermined shape;

(g) a socket means axially formed in said head member by a combination of said cavity in a first one of said pair of semi-circular inserts and said cavity in a second one of said pair of semi-circular inserts when said pair of generally C-shaped collars are disposed in said first position for closing said generally C-shaped open first end, wherein said first semi-circular insert and said second semi-circular insert form a ratchet wheel;

(h) a ratchet pawl means disposed within said second end of said head member and partially protruding into said generally C-shaped open first end for engaging said ratchet wheel, said ratchet pawl means enabling coupled rotation of said ratchet wheel in combination with said pair of generally C-shaped collars, said head member and said handle in one direction for transferring a torque to such fastener, said torque is generated by a manual force applied to said handle, said ratchet pawl means enabling rotation of said pair of generally C-shaped collars, said head member and said handle in an opposed direction while said ratchet wheel is maintained in a temporary stationary position.

2. The wrench, according to claim 1, wherein each of said generally C-shaped collars includes a groove for receiving said arcuate edge of said each of said pair of semi-circular inserts.

3. The wrench, according to claim 1, wherein said wrench includes a retaining means for retaining said each semi-circular insert within said respective one of said pair of generally C-shaped collars.

4. The wrench, according to claim 3, wherein said retaining means includes one of said pair of semi-circular inserts and said pair of generally C-shaped collars having magnetic properties.

5. The wrench, according to claim 1, wherein said locking means is a tab mounted for linear movement in said head member, said tab movable in a first direction for engaging a pair of notches each disposed in a respective one of said pair of generally C-shaped collars and for locking said pair of generally C-shaped collars in said first position and in a second direction for disengaging said pair of notches and for enabling pivotal movement of said pair of generally C-shaped collars into said second position.

* * * * *